US007351381B2

(12) United States Patent
Ball et al.

(10) Patent No.: US 7,351,381 B2
(45) Date of Patent: Apr. 1, 2008

(54) GAS TREATMENT APPARATUS

(75) Inventors: William Frederick Ball, Nettleham (GB); Anthony John Gault, Gainsborough (GB); Charles Patrick Harrod, Saxilby (GB)

(73) Assignee: Eminox Limited (GB)

( * ) Notice: Subject to any disclaimer, the term of this patent is extended or adjusted under 35 U.S.C. 154(b) by 690 days.

(21) Appl. No.: 10/830,985

(22) Filed: Apr. 23, 2004

(65) Prior Publication Data

US 2004/0228776 A1 Nov. 18, 2004

Related U.S. Application Data

(63) Continuation of application No. PCT/GB02/04762, filed on Oct. 21, 2002.

(51) Int. Cl.
*B01D 50/00* (2006.01)
*F01N 3/10* (2006.01)
*F01N 3/00* (2006.01)

(52) U.S. Cl. ..... 422/170; 422/174; 422/171; 422/179; 422/180; 60/282; 60/288

(58) Field of Classification Search ..... 422/180, 422/170, 171, 174, 179; 181/258; 60/288, 60/282

See application file for complete search history.

(56) References Cited

U.S. PATENT DOCUMENTS

| | | | | |
|---|---|---|---|---|
| 3,793,830 | A * | 2/1974 | August | 60/288 |
| 3,853,483 | A * | 12/1974 | Cross, Jr. | 422/179 |
| 3,913,323 | A * | 10/1975 | August | 60/288 |
| 4,248,833 | A | 2/1981 | Aoyama | |
| 4,448,754 | A | 5/1984 | Isogai et al. | |
| 5,614,155 | A * | 3/1997 | Abe et al. | 422/174 |
| 5,746,986 | A * | 5/1998 | Pollock et al. | 422/177 |
| 5,766,559 | A * | 6/1998 | Blanchet et al. | 422/171 |
| 5,921,079 | A * | 7/1999 | Harris | 60/288 |
| 6,312,650 | B1 * | 11/2001 | Frederiksen et al. | 422/180 |
| 7,029,634 | B2 * | 4/2006 | Sherwood, Jr. | 422/177 |
| 7,117,827 | B1 * | 10/2006 | Hinderks | 123/43 R |

FOREIGN PATENT DOCUMENTS

| | | |
|---|---|---|
| DE | 19508217 | 9/1996 |
| DE | 19755703 | 6/1999 |
| GB | 2357046 | 6/2001 |
| GB | 2357048 | 6/2001 |

OTHER PUBLICATIONS

United Kingdom Search Report.
PCT Search Report.

* cited by examiner

*Primary Examiner*—Walter D. Griffin
*Assistant Examiner*—Huy-Tram Nguyen
(74) *Attorney, Agent, or Firm*—Bourque and Associates

(57) ABSTRACT

The present invention relates to a gas treatment apparatus for treating the exhaust gas stream from an internal combustion engine. The apparatus comprises several compartments within which one or more treatments are to be performed upon a gas flowing through the compartments. At least one compartment includes a treatment element secured against axial movement at each end. The treatment element is secured at least at one end by removable axial retaining apparatus. The removable axial retaining apparatus includes a secured member secured against axial movement. The treatment element is removable from within the compartment by axial movement after the removable axial retaining apparatus has been removed.

44 Claims, 5 Drawing Sheets

GAS TREATMENT APPARATUS

TECHNICAL FIELD OF THE INVENTION

The present invention relates to a gas treatment apparatus for treating an exhaust gas flow, particularly an exhaust gas flow from an internal combustion engine. The invention particularly relates to a gas treatment apparatus for treating the exhaust gas flow from an internal combustion engine in a vehicle and extends to a vehicle equipped with such apparatus.

DESCRIPTION OF THE RELATED ART

Diesel engine exhaust gases contain a number of noxious gases, such a nitrogen oxides, sulphur oxides and carbon oxides, as well as un-burnt hydrocarbons, carbon and other particles. The amount of sulphur oxides in the exhaust gases is dependent primarily upon the sulphur in the fuel and is controlled by the quality of the initial crude oil and the refining techniques used in the preparation of the fuel. However, the other materials can be treated so as to render them less obnoxious.

It is therefore common practice to pass the exhaust gases through one or more treatment chambers containing a catalytic converter in which the lower nitrogen oxides are converted to $NO_2$. The particulates are removed from the exhaust gas stream by a metal gauze or mesh or a ceramic filter element. The $NO_2$ and oxygen in the gas stream react with the carbon particulates trapped in the filter element to form carbon dioxide, which is then discharged with the other exhaust gases. The filtered gases then discharged with the other exhaust gases. The filtered gases can then be subjected to reduction of remaining nitrogen oxides to nitrogen by injecting a reducing agent such as a solution of urea into the gas stream after it leaves the filter element but before it leaves the silencer unit. The treated gas stream is then passed over a further catalyst to convert residual ammonia from the urea to nitrogen and water, which are acceptable exhaust emissions. The net result is a typical reduction in noxious components of the exhaust gases of over 90%.

It is known that if a filtration treatment element is removed from the apparatus and refitted such that gas flows through the filtration treatment element in the opposite direction the useful life of the filtration treatment element can be extended. Other treatment elements may require replacement or servicing and different treatment elements may have different service intervals. It is therefore desirable to be able to remove individual treatment elements such that they may be individually serviced without the need to substantially dismantle the gas treatment apparatus.

It is usual to permanently secure a treatment element within a compartment or chamber forming part of the apparatus such that the entire compartment must be removed and serviced or replaced if needed. This approach is difficult to satisfactorily achieve with a gas treatment apparatus having a central compartment and an annular compartment located around the central compartment in a generally concentric arrangement. If both central and annular compartments contain a treatment element, the wall of the central compartment forms part of both the central and annular compartments, so the treatment elements can not both be permanently secured to the same wall and be individually replaceable.

SUMMARY OF THE INVENTION

It is an object of the present invention to address some of these issues.

Accordingly the invention provides a gas treatment apparatus for treating the exhaust gas stream, the apparatus comprising a plurality of compartments within which one or more treatments are to be performed upon a gas flowing through said compartments, the gas treatment apparatus including a removable endcap, at least one compartment including a treatment element therein secured against axial movement at each end of said treatment element, characterised in that the treatment element is secured at least at one end by removable axial retaining apparatus comprising a secured member secured against axial movement, the treatment element being removable from within the compartment by axial movement of said treatment element after removal of the removable endcap and axial retaining apparatus.

The term 'treatment element' is used herein to describe filters, catalysts and the like that can be used to treat an exhaust gas stream. The term is used to include any surrounding padding and casing material such as shock absorbing padding or a metal casing that may be present surrounding the treatment element.

An endcap on such gas treatment apparatus extends transverse to the gas flow and prevents gas flow in the axial direction and is usually used to seal the ends of the apparatus. A removable endcap allows access to the internal compartments and the treatment elements within the gas treatment apparatus and allows a treatment element to be moved axially and removed from the apparatus. The endcap may be removable by itself, or as part of a larger removable section of the apparatus that may include portions of one or more compartment walls.

By providing a removable retaining apparatus at at least one end of the treatment element, the treatment element may be removed from within a compartment for replacement or servicing without moving or removing the walls of said compartment.

Since the treatment element can be removed from within the compartment, the walls of the compartment may be permanently secured in place in the apparatus, or other treatment elements that do not require removal may be permanently secured to the compartment walls. This may give the apparatus greater strength or resilience to damage or deformation.

Preferably the removable retaining apparatus does not substantially restrict the gas flow passing through the compartment. This can be achieved in a number of ways, for instance a perforated baffle plate or similar, but preferably the removable retaining apparatus is substantially annular and retains only the periphery of the treatment element. The retaining apparatus may extend radially inwards preferably no more than about 10% of the radius of the treatment element, and will preferably extend radially inward no more than 2 cm.

Often there are regions of a treatment element through which a gas may not easily flow, thus creating a flow restriction. These are often located at the radial periphery of a treatment element and may be a shock absorbing padding and/or a casing. If such a flow restriction exists, the retaining apparatus may preferably extend radially inwards substantially no further than the radial extent of the flow restriction.

The secured member of the removable retaining apparatus may be secured against axial movement by engagement with the removable endcap, which is fixed in place during operation of the apparatus. The secured member may be permanently or releasably attached to the removable endcap. Since the secured member is retained by the removable endcap, removal of the endcap during servicing releases the axial restraint on the treatment element and allows said treatment element to be moved axially and removed from the gas treatment apparatus. To allow for tolerances, there may be a resilient member between the endcap and secured member or there may be an adjustable member. The adjustable member may include for example pins on the secured member engaging in axially sloping slots on the endcap or series of axially sloping ramps on both the endcap and secured member. The secured member may be secured against rotation and the endcap then rotated on assembly until the axial location of the secured member is correct.

The removable retaining apparatus may include gaskets and/or spacers between the treatment element and secured member. The use of spacers or gaskets can be adapted, for instance by the addition or removal of one or more spacers or gaskets, to account for manufacturing tolerances in the compartment sizes or in the size of the treatment elements. By allowing for such differences in manufacturing tolerances, secure axial retention can be ensured even when replacing a treatment element in existing treatment apparatus. Gaskets can be used to prevent gas flowing between the treatment element and the wall of the compartment and thereby bypassing the treatment element. The spacers may be resiliently deformable at least in the axial direction, for instance springs, cylindrical bellows or other resiliently deformable annular members. There may be a combination of gaskets and spacers used together in any order. The combination will preferably include a gasket adjacent to the treatment element to form a gas seal.

The secured member may be secured axially by engagement of at least one radial projection from the secured member with a slot in the wall of the compartment. Preferably there are a plurality of such projections and slots. The projections are preferably formed integrally with the secured member, but may be attached after formation of the secured member by welding, soldering, riveting or other attachment process. In some embodiments the projections may form hooks to engage with slots in the compartment wall to retain the secured member axially.

The slots in the wall of the compartment may be radially directed apertures through the wall of the compartment and may pass into the wall substantially perpendicular to the wall. It is possible that the slots may not pass into the wall substantially perpendicular and they may be angled away from the treatment element such that an axial force from the direction of the treatment element causes the projections to be forced into the slots. The slots may pass completely through the wall of the compartment, or may only pass part of the way through the wall to form grooves.

Preferably if the secured member includes projections that engage with slots in the wall of the compartment the secured member will be in the form of a split ring. This will allow easy removal of the secured member by prising one end away from the cylinder and gradually 'peeling' the secured member away from the compartment wall until the far end is reached. This will not damage the securing member and so it can be reused and refitted to axially retain a treatment element after servicing or replacement. It is preferable that any securing member can be reused after removal, but it is possible that a securing member could be used that was designed to be easily destroyed for removal. For instance an annular baffle that could be pushed only one way within the compartment. Such a baffle may be a dished washer with peripheral edges that engage with the compartment wall to prevent removal. The baffle may be a washer that engages with a ratchet arrangement of grooves or ridges on the compartment wall that allow a washer to travel past them in only one direction. Such a baffle could be used to secure the treatment element and then cut to remove it. This approach may be preferable where the disposable part can be constructed cheaply and the fitting and/or removal of such a disposable part is quicker or easier during maintenance.

The secured member may include a radially inwardly directed portion, as this provides a surface against which the treatment element may be retained. It is desirable that the treatment element be secured axially such that the treatment element may not move. This may be achieved by the use spacers or gaskets as previously discussed. A similar result could be achieved by providing threaded bolts through the radially directed portion of the secured member. The bolts could be adjusted such that they pressed upon the end of the treatment element and thereby secured it in place. An adjustable spacing member may also be used to achieve the same result.

An adjustable spacing member may be located between the secured member and the treatment element. The spacing member being adjustable such that the axial extent of said spacing member between the secured member and the treatment element may be altered until the treatment element is secured against axial movement. An adjustable spacing member performs the same function as a number of spacers or gaskets that may be added or removed as needed. The use of an adjustable spacing member requires fewer washers or gaskets to be used to provide secure axial retention and may facilitate servicing.

An embodiment of such an adjustable spacing member is a split ring member with an adjustable circumference. The circumference may be adjusted by rotating a bolt that joins the two ends of the split ring. The split ring member has a radially outwardly narrowing edge portion that is to be located between the treatment element and the secured member. As the bolt is rotated, the circumference of the ring member is increased, thereby increasing the axial extent of the spacer member between the treatment element and the secured member as the edge portion is forced radially outward. It should be noted that there are other embodiments of such an expandable spacer, for instance inflatable or deformable spacers.

The secured member may be formed integrally with the treatment element, for instance radial projections from the periphery of the treatment element that engage with slots in the compartment wall, possibly in a 'bayonet' type fitting.

The treatment element may be secured, either permanently or releasably, to a part of the removable retaining apparatus such that as the retaining apparatus is moved, the treatment element is also moved. This can assist with the removal of treatment elements from compartments, particularly when the compartment is vertically orientated.

The treatment element may include a lip or shoulder with which the part of the retaining apparatus could engage, or the treatment element could be adapted to include such a lip or shoulder to aid removal.

A treatment element including such a lip or shoulder may be removed by a removal tool that is adapted to engage the lip or shoulder when the retaining apparatus has been removed.

The compartment wall surrounding the treatment element may include an annular joint between two sections of the compartment. The joint may include radially outwardly directed flanges secured together by a circumferential substantially V-shaped strap. The joint may also include an annular gasket. Such a joint may be used to house one or more annular seals to prevent the gas from flowing between the wall and the treatment element. The annular seals may be made from rubber, but will preferably be made from a ceramic string or braid, which may be impregnated with graphite, with a diameter of no more than about 1 cm and preferably less than about 0.5 cm. The cross section of the annular seal may be circular, but have any suitable cross-section, for instance square or rectangular. It is preferred that if annular joint is to be formed in the wall of a compartment containing a treatment element, said joint is formed in the wall surrounding the treatment element to provide a seal location.

The gas treatment apparatus may include an annular compartment substantially surrounding a central compartment in a generally concentric arrangement. The annular compartment may include therein one or more removable treatment elements. To help support the central compartment the annular compartment may also include one or more radially extending annular support vanes therein to transfer loads from the central compartment to the outer wall of the annular compartment.

A support vane would extend radially from the central compartment to the outer wall of the annular compartment and help to support the central compartment. The support vane may be located before or after a treatment element and is preferably therefore removable.

Manufacturing tolerances are often not particularly strict during the construction of gas treatment compartments, so preferably the support vane is able to adapt slightly to account for any such manufacturing variations. This may be achieved by making the vane resiliently deformable in the radial direction such that manufacturing or other variations can be accommodated without substantial loss of support for the central compartment.

The support vanes are preferably axially positioned within the annular compartment to substantially align with external support brackets for the gas treatment apparatus. This allows forces acting upon the central container to be transferred to the bracket more directly and reduces the chance of the annular compartment wall being deformed.

The support vanes may be made from several workpieces joined together, or from a single workpiece such as a strip or flattened tube that is stamped, pressed or otherwise formed into the desired shape, for instance a zig-zag or substantially square-wave profile round the circumference.

A single annular workpiece may be formed into a suitable support vane by stamping a plurality of holes through the workpiece to reduce the gas flow resistance of the support vane. Inner and outer edge portions of the annular workpiece may be folded at an angle to the annular workpiece to permit a degree of adaptability for variations in manufacturing by flexing of the edge portions towards a central axis of the workpiece. The edge portions may also be curved slightly in the axial direction such that the edge portions furthest from the workpiece are angled towards a central axis of the workpiece to permit easier fitting of the support vane within the apparatus.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
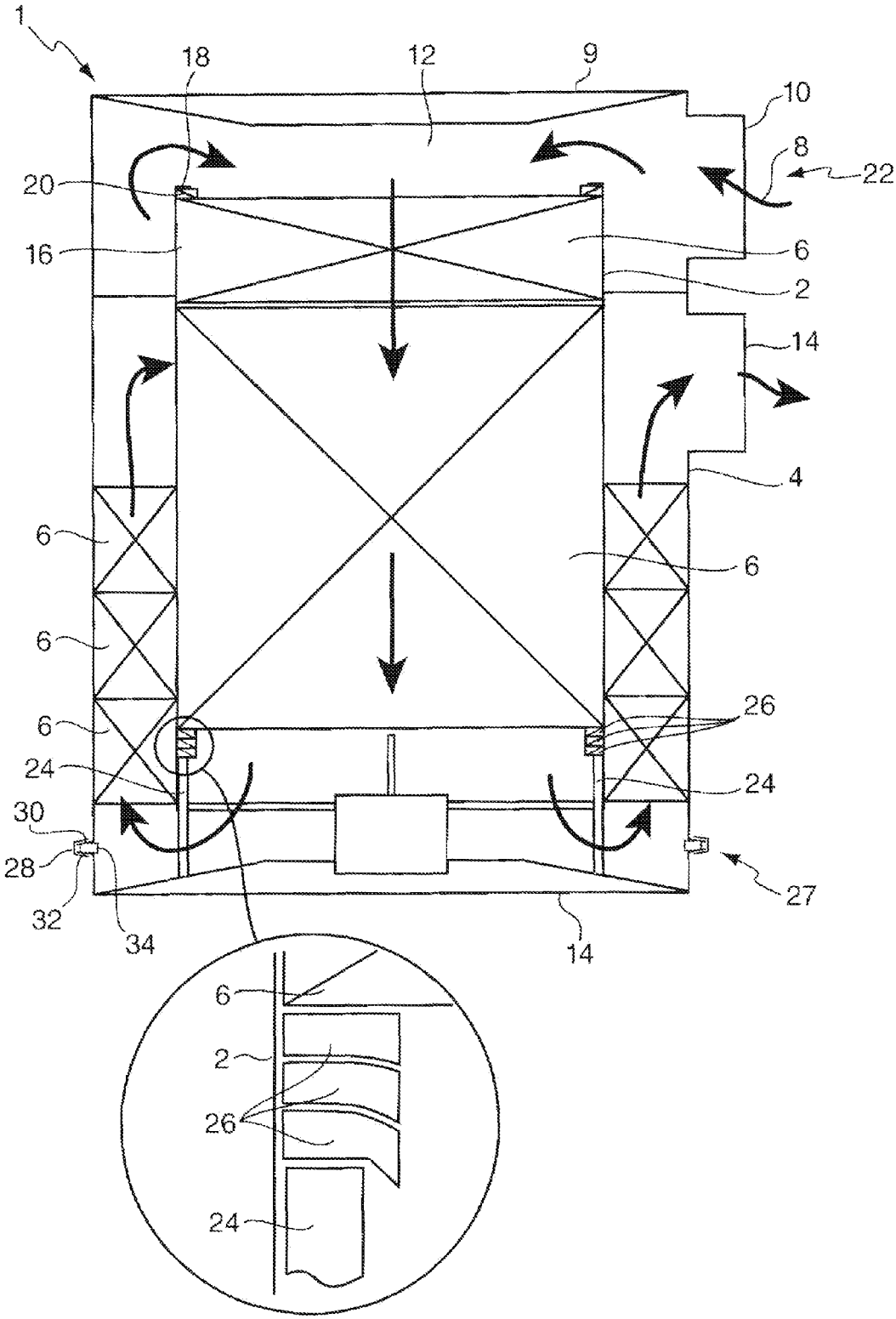
FIG. 1 shows a cross section of a gas treatment apparatus according to the invention having removable axial retaining apparatus including a securing means attached to an endcap of the apparatus.

FIG. 1 shows a gas treatment apparatus 1 having central compartment 2 and an annular compartment 4 substantially surrounding the central compartment 2 in a generally concentric arrangement. Within the compartments 2,4 are located treatment elements 6 for treating a gas stream passing through said elements 6.

Arrows 8 indicate the flow path of the gas. The gas enters the apparatus 1 through an inlet 10 near an end 9 of the apparatus 1. The gas then passes into the central compartment 2 through chamber 12. The gas passes down the length of the apparatus 1 and reaches an endcap 14, at which point the gas flow is reversed and the gas enters the annular compartment 4.

Gas passing through the annular compartment 4 passes through further treatment elements 6 and then exits the apparatus through outlet 14.

The central compartment has at a distal end 16 permanently formed inwardly directed axial retaining flanges 18 to prevent the treatment elements 6 within the central compartment 2 from moving towards the end 9. Between the flange 18 and the treatment element 6 is an annular gasket 20 to create a good gas seal.

At a proximal end 22 of the central compartment 2 the treatment elements 6 are axially retained by removable retaining apparatus comprising a secured member 24 which is permanently attached to the endcap 14 and extends axially from the endcap 14 towards the periphery of treatment elements 6. Three resiliently deformable annular gaskets 26 are located between the secured member 24 and the treatment elements 6 to allow for any variation in axial dimensions and to create a good gas seal.

It should be understood that the secured member 24 could be an annular member including apertures through which gas may pass, or could comprise a number of separate members that retain the treatment element 6 at a number of location around the periphery of the treatment element 6.

The endcap 14 is removable from the apparatus 1. The endcap is secured to the apparatus 1 by the joint 27. A circumferential strap 28, which holds radially outwardly directed flanges 30,32 against an annular gasket 34. Releasing the circumferential strap 28 allows the endcap 14 and hence the secured member 24 to be removed.

Figure 4:
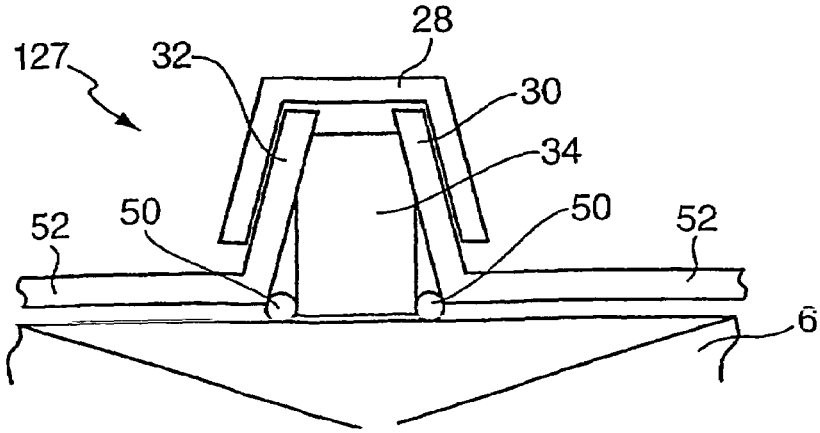
FIG. 4 shows an annular gas seal in a flanged joint.

A joint 127 is shown in FIG. 4, but in FIG. 4 the joint 127 includes annular sealing rings 50 that are not present in joint 27.

Figure 2:
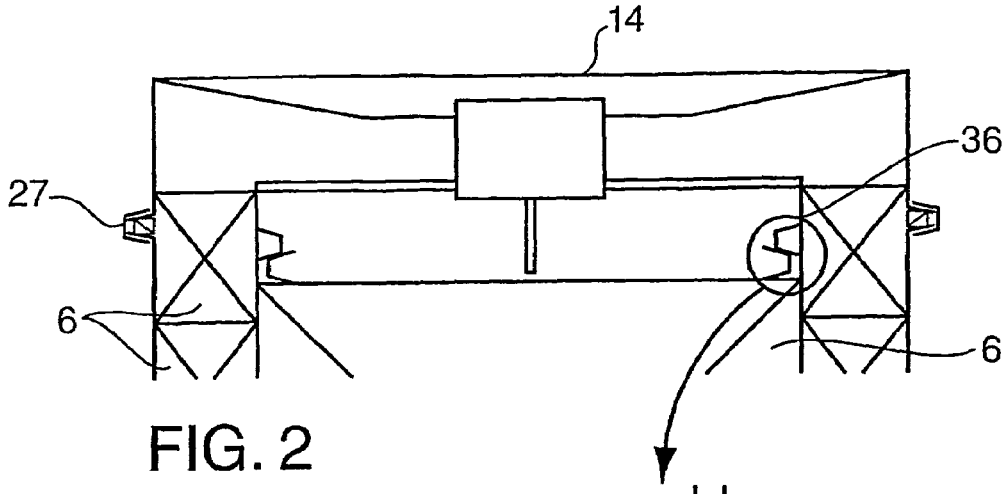
FIG. 2 shows a second embodiment of the securing means of FIG. 1.
Figure 3:
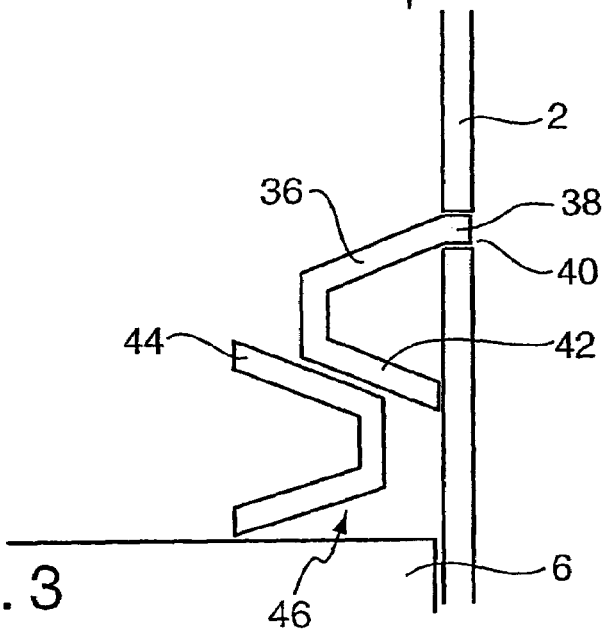
FIG. 3 shows the embodiment of FIG. 2 in more detail.

FIGS. 2 and 3 shows a second embodiment of the removable axial retaining apparatus. The secured member 36 is secured axially by engagement of projections 38 from the secured member 36 with slots 40 in the wall of the central compartment 2. There are a plurality of projections 38 engaged with slots 40 around the circumference of the central compartment 2 to prevent movement of the secured member in the axial direction. The secured member 36 is a split ring and to remove said ring a first end is prised away from the wall of the central compartment 2 such that a projection 38 is released from a slot 40. This process continues around the circumference until the securing member is 'peeled' from the wall and can be removed.

The securing member extends radially inwards and provides a radial wall 42 against which the treatment element 6 may be secured.

An expanding spacer ring 44 with a radially outwardly narrowing edge portion 46 is located between the treatment element 6 and the secured member 36. Initially the spacer ring 44 has a circumference that allows it to pass through the securing member, but once in place, the spacer ring 44 is expanded by means of a bolt (not shown). The expansion causes the edge portion 46 to be forced radially outward between the secured member 36 and the treatment element 6 and hence secure the treatment element 6 against axial movement. This also helps to secure the secured member 36 in place.

FIG. 4 shows a detailed cross section of a flanged annular joint 127. The joint 127 is very similar to joint 27, but includes annular sealing rings 50 on either side of the gasket 34.

As the circumferential strap 28 is tightened, the gasket 34 is compressed and the annular sealing rings 50 are forced onto the surface of the treatment element 6. The annular sealing rings 50 therefore form a gas seal preventing gas from flowing between the treatment element 6 and a wall 52 of the compartment and thereby avoiding being treated within the element 6.

Figure 5:
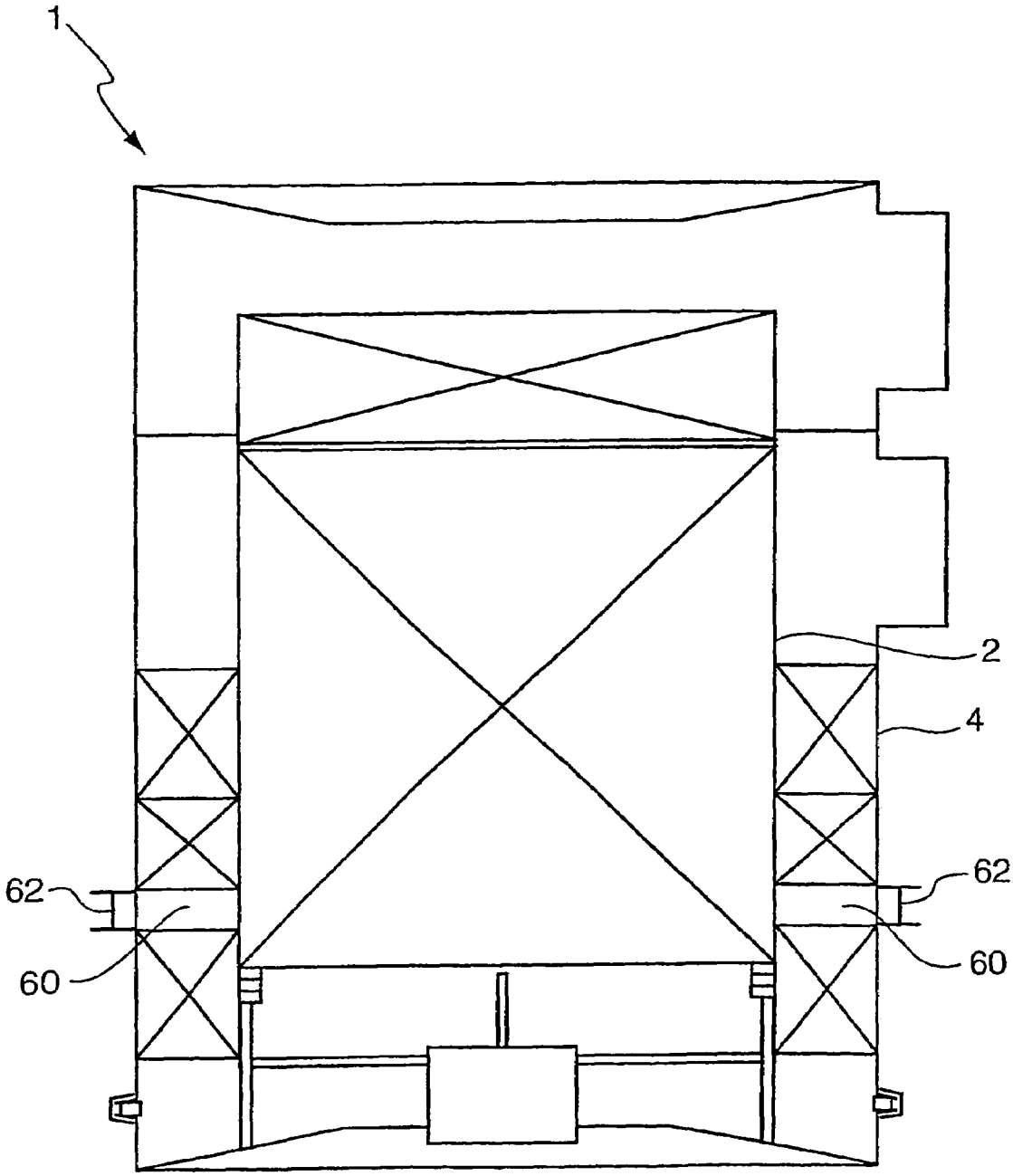
FIG. 5 shows the gas treatment apparatus of FIG. 1 including a support vane within the annular compartment.

FIG. 5 shows the gas treatment apparatus 1 of FIG. 1 including a support vane 60 in the annular compartment 4. The support vane 60 helps to transfer loads between the central compartment 2 and the annular compartment 4. In this instance the support vane 60 is located between treatment elements 6 at the axial location of a support bracket 62 used for securing the gas treatment apparatus 1 to a mount (not shown).

Figure 6:
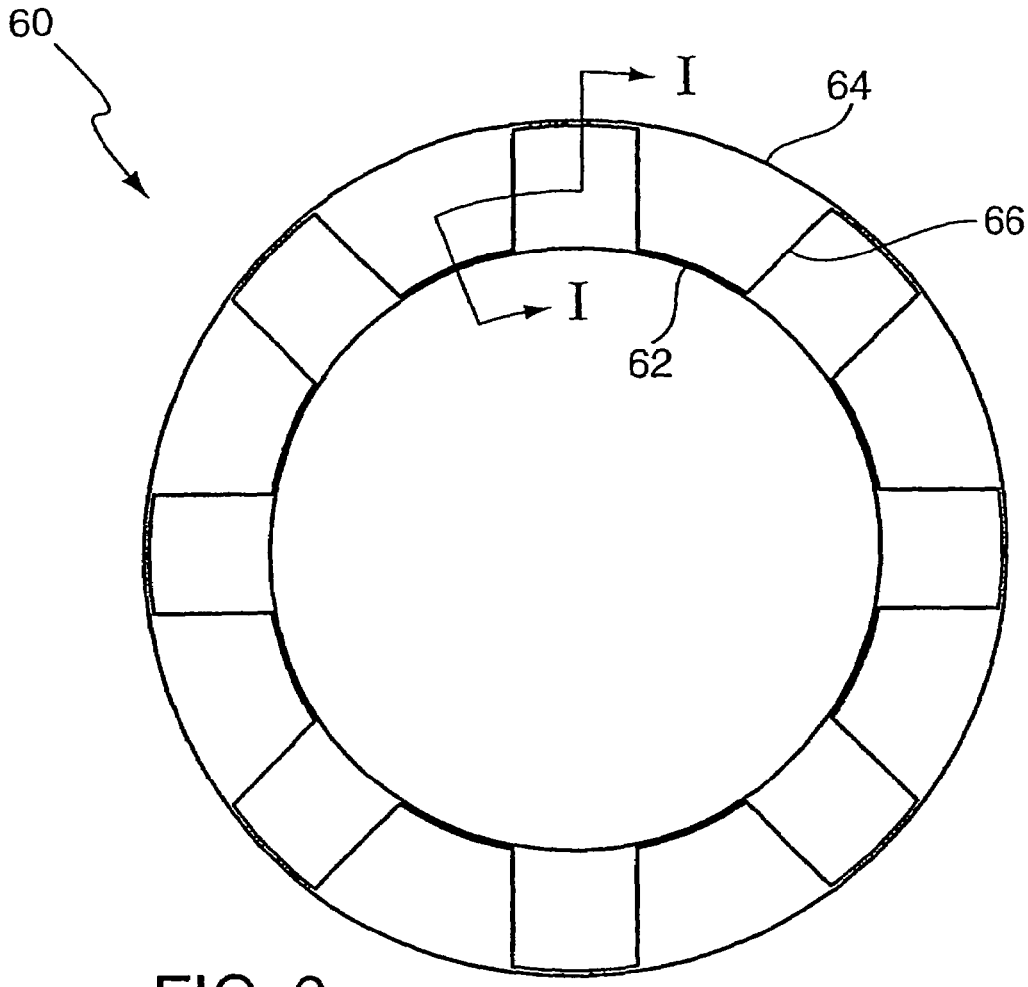
FIG. 6 show a plan view of the support vane of FIG. 5.
Figure 7:
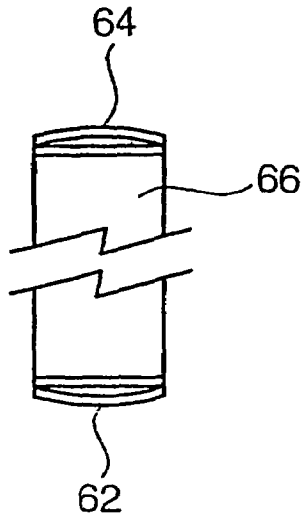
FIG. 7 shows a cross section through the support vane of FIG. 6 along the line I-I.

FIGS. 6 and 7 show a more detailed view of support vane 60 in plan view and in cross section along the line I-I respectively.

The support vane 60 has an inner and an outer containing wall 62,64. These walls are generally spaced apart in a concentric arrangement by the internal walls 66. The inner and outer walls are bowed in the radial direction away from the internal walls 66 as shown in FIG. 7. This slight bow in the walls of the support vane 60 allows for easier fitting and removal of the vane and also helps to permit the support vane 60 to be located in the annular compartment 4 even though there may be variations in radial dimensions due to manufacturing tolerances.

As can be seen from the drawings, the internal walls 66 are formed from a single strip of metal that has been folded to form a square wave pattern and has then been formed into a circle between the inner and outer walls 62,64. The walls are held secured to the walls in only 4 places on each wall as this allows there to be some degree of movement between the internal walls 66 and the inner and outer wall 62,64 to accommodate manufacturing variations.

It should be noted from FIG. 6 that the support vane 60 has a very low cross sectional area and so will not significantly restrict flow or significantly increase the pressure loss within the apparatus.

Figure 8:
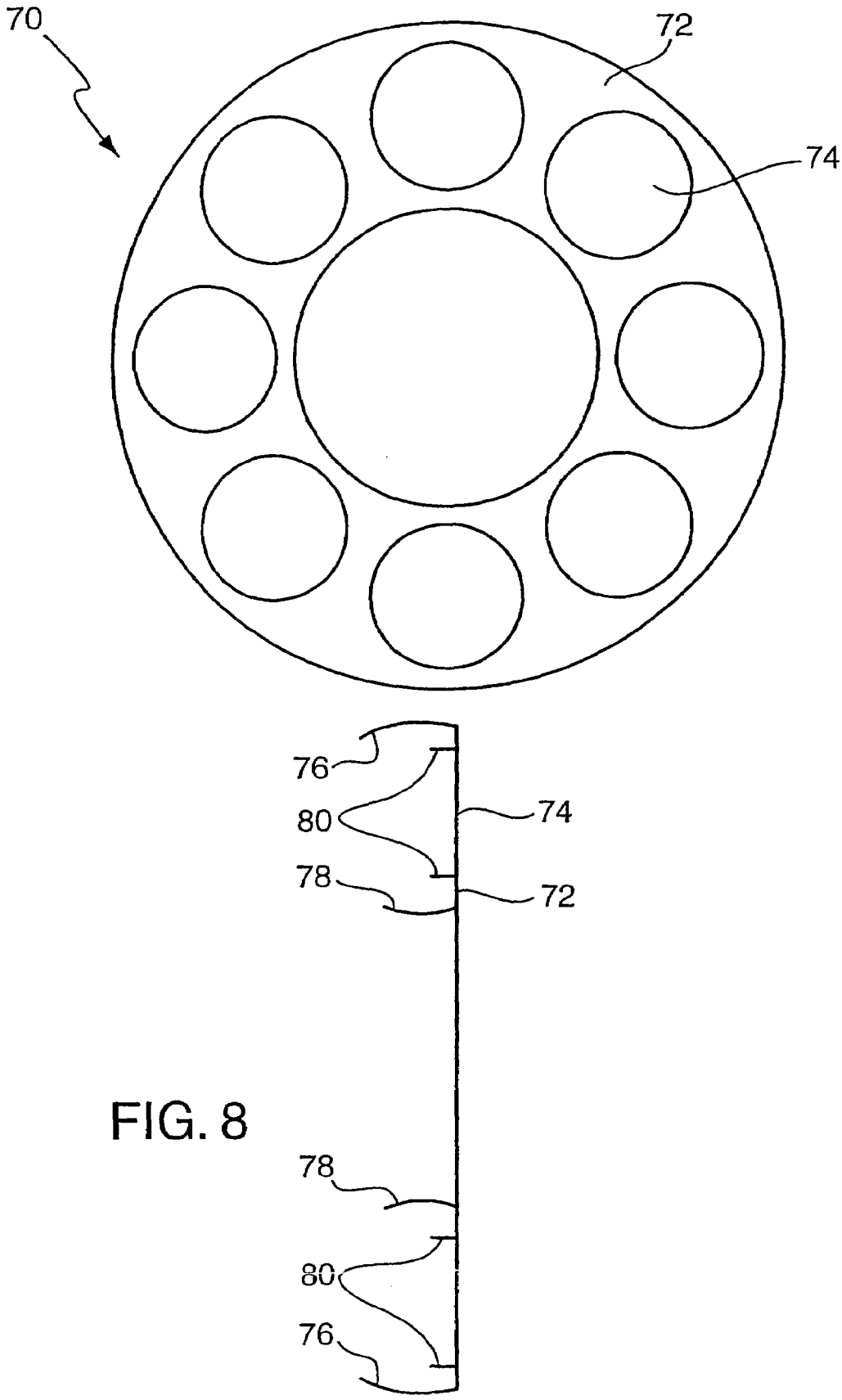
FIG. 8 shows a second embodiment of the support vane of FIG. 5.

FIG. 8 shows a plan view and cross section of a second embodiment 70 of a support vane 60 for use in the invention.

The support vane 70 is formed from a single annular workpiece 72 and has holes 74 stamped through it. Edge portions 76,78 are folded at an angle to the workpiece 72 and are curved to facilitate fitting of the support vane 70. The curve and fold also allow the edge portions to flex slightly to accommodate manufacturing variations in the size or shape of the annular compartment 4. The holes 74 have flanges 80 around their periphery to increase the strength of the support vane 70.

Apparatus according to the invention allows at least some of the treatment elements with a gas treatment apparatus to be replaced or serviced without the need for replacement of the entire apparatus. This results in a lower degree of wastage and therefore reduces overall costs to both the consumer and manufacturer. This sort of removable axial retaining means is particularly useful with concentrically arranged gas treatment apparatus and greatly facilitates servicing of such apparatus. Gas treatment apparatus according to the invention is particularly intended for use to treat the exhaust gas from a vehicle engine prior to emission to the atmosphere.

The invention claimed is:

1. Gas treatment apparatus for treating the exhaust gas stream, the apparatus comprising a plurality of compartments within which one or more treatments are to be performed upon a gas flowing through said compartments, the gas treatment apparatus including a removable endcap, at least one central compartment including a treatment element therein secured against axial movement at each end of said treatment element, said central compartment being substantially surrounded by an annular compartment in a substantially concentric arrangement, characterised in that the end cap is secured to the apparatus by a circumferential clamp and the treatment element is secured at least at one end by removable axial retaining apparatus comprising a secured member secured against axial movement, the treatment element being removable from within the central compartment by axial movement of said treatment element after removal of the removable end cap and axial retaining apparatus, wherein the secured member is secured in place by engagement of at least one projection from said secured member with a slot in the wall of the compartment, wherein the secured member is a split ring having a radially inwardly directed portion and in which the removable retaining apparatus further includes an expandable annular member for location between the treatment element and the secured member, the expanding annular member including a radially outwardly narrowing peripheral portion.

2. Gas treatment apparatus as claimed in claim 1, in which the removable axial retaining apparatus prevents axial movement of the treatment element by retaining only the periphery of the treatment element.

3. Gas treatment apparatus as claimed in claim 1, in which the secured member of the removable retaining apparatus is axially retained by the removable endcap of the apparatus such that removal of the endcap enables removal of the treatment element.

4. Gas treatment apparatus as claimed in claim 1, in which a plurality of projections engages with a plurality of slots in the wall of the compartment.

5. Gas treatment apparatus as claimed in claim 1, in which the removable retaining apparatus includes at least one ring gasket between the treatment element and the secured member.

6. Gas treatment apparatus as claimed in claim 1, in which resiliently axially deformable spacers are located between the secured member and the treatment element.

7. Gas treatment apparatus as claimed in claim 1, in which the wall enclosing the treatment element includes an annular joint between two sections of the compartment, the adjacent ends of each section having radially outwardly extending flanges between which a gasket is located, the flanges being held together by a circumferential substantially V-shaped strap, characterised in that the joint includes at least one sealing ring that prevents gas flowing past the treatment element.

8. Gas treatment apparatus as claimed in claim 7, in which the sealing ring is a ceramic string.

9. A vehicle comprising gas treatment apparatus for the treatment of an exhaust gas stream from an internal combustion engine, the gas treatment apparatus being as claimed in claim 1.

10. Gas treatment apparatus for treating the exhaust gas stream, the apparatus comprising a plurality of compartments within which one or more treatments are to be performed upon a gas flowing through said compartments, the gas treatment apparatus including a removable endcap, at least one central compartment including a treatment element therein secured against axial movement at each end of said treatment element, said central compartment being substantially surrounded by an annular compartment in a substantially concentric arrangement, characterised in that the end cap is secured to the apparatus by a circumferential clamp and the treatment element is secured at least at one end by removable axial retaining apparatus comprising a secured member secured against axial movement, the treatment element being removable from within the central compartment by axial movement of said treatment element after removal of the removable endcap and axial retaining apparatus, in which the secured member is reusable after removal.

11. Gas treatment apparatus as claimed in claim 10, in which the removable axial retaining apparatus prevents axial movement of the treatment element by retaining only the periphery of the treatment element.

12. Gas treatment apparatus as claimed in claim 10, in which the secured member of the removable retaining apparatus is axially retained by the removable endcap of the apparatus such that removal of the endcap enables removal of the treatment element.

13. Gas treatment apparatus as claimed in claim 10, in which the secured member is secured in place by engagement of at least one projection from said secured member with a slot in the wall of the compartment.

14. Gas treatment apparatus as claimed in claim 13, in which a plurality of projections engage with a plurality of slots in the wall of the compartment.

15. Gas treatment apparatus as claimed in claim 13, in which the secured member is a split ring having a radially inwardly directed portion.

16. Gas treatment apparatus as claimed in claim 10, in which the removable retaining apparatus includes at least one ring gasket between the treatment element and the secured member.

17. Gas treatment apparatus as claimed in claim 10, in which resiliently axially deformable spacers are located between the secured member and the treatment element.

18. Gas treatment apparatus as claimed in claim 10, in which the wall enclosing the treatment element includes an annular joint between two sections of the compartment, the adjacent ends of each section having radially outwardly extending flanges between which a gasket is located, the flanges being held together by a circumferential substantially V-shaped strap, characterised in that the joint includes at least one sealing ring that prevents gas flowing past the treatment element.

19. Gas treatment apparatus as claimed in claim 8, in which the sealing ring is a ceramic string.

20. A vehicle comprising gas treatment apparatus for the treatment of an exhaust gas stream from an internal combustion engine, the gas treatment apparatus being as claimed in claim 10.

21. Gas treatment apparatus for treating the exhaust gas stream, the apparatus comprising a plurality of compartments within which one or more treatments are to be performed upon a gas flowing through said compartments, the gas treatment apparatus including a removable endcap, at least one central compartment including a treatment element therein secured against axial movement at each end of said treatment element, said central compartment being substantially surrounded by an annular compartment in a substantially concentric arrangement, characterised in that the end cap is secured to the apparatus by a circumferential clamp and the treatment element is secured at least at one end by removable axial retaining apparatus comprising a secured member secured against axial movement, the treatment element being removable from within the central compartment by axial movement of said treatment element after removal of the removable end cap and axial retaining apparatus, and in which there is an annular treatment compartment surrounding a central compartment, the annular compartment including removable treatment elements, the annular compartment also including radially extending support vanes for supporting the central compartment. characterised in that the support vanes are removable.

22. Gas treatment apparatus as claimed in claim 21, in which the support vanes are located within the annular compartment at or adjacent the axial location of an external bracket for securing the apparatus.

23. Gas treatment apparatus as claimed in claim 21, in which the removable axial retaining apparatus prevents axial movement of the treatment element by retaining only the periphery of the treatment element.

24. Gas treatment apparatus as claimed in claim 21, in which the secured member of the removable retaining apparatus is axially retained by the removable endcap of the apparatus such that removal of the endcap enables removal of the treatment element.

25. Gas treatment apparatus as claimed in claim 21, in which the secured member is secured in place by engagement of at least one projection from said secured member with a slot in the wall of the compartment.

26. Gas treatment apparatus as claimed in claim 25, in which a plurality of projections engage with a plurality of slots in the wall of the compartment.

27. Gas treatment apparatus as claimed in claim 25, in which the secured member is a split ring having a radially inwardly directed portion.

28. Gas treatment apparatus as claimed in claim 21, in which the removable retaining apparatus includes at least one ring gasket between the treatment element and the secured member.

29. Gas treatment apparatus as claimed in claim 21, in which resiliently axially deformable spacers are located between the secured member and the treatment element.

30. Gas treatment apparatus as claimed in claim 21, in which the wall enclosing the treatment element includes an annular joint between two sections of the compartment, the adjacent ends of each section having radially outwardly extending flanges between which a gasket is located, the flanges being held together by a circumferential substantially V-shaped strap, characterised in that the joint includes at least one sealing ring that prevents gas flowing past the treatment element.

31. Gas treatment apparatus as claimed in claim 30, in which the sealing ring is a ceramic string.

32. A vehicle comprising gas treatment apparatus for the treatment of an exhaust gas stream from an internal combustion engine, the gas treatment apparatus being as claimed in claim 21.

33. Gas treatment apparatus for treating the exhaust gas stream, the apparatus comprising a plurality of compartments within which one or more treatments are to be performed upon a gas flowing through said compartments, the gas treatment apparatus including a removable endcap, at least one central compartment including a treatment element therein secured against axial movement at each end of said treatment element, said central compartment being substantially surrounded by an annular compartment in a substantially concentric arrangement, characterised in that the end cap is secured to the apparatus by a circumferential clamp and the treatment element is secured at least at one end by removable axial retaining apparatus comprising a secured member secured against axial movement, the treatment element being removable from within the central compartment by axial movement of said treatment element after removal of the removable endcap and axial retaining apparatus, which the removable treatment element includes a lip or shoulder.

34. Gas treatment apparatus as claimed in claim 33, in which the removable retaining apparatus engages with the lip or shoulder of the treatment element to aid removal of said treatment element.

35. Gas treatment apparatus as claimed in claim 33, in which the removable axial retaining apparatus prevents axial movement of the treatment element by retaining only the periphery of the treatment element.

36. Gas treatment apparatus as claimed in claim 33, in which the secured member of the removable retaining apparatus is axially retained by the removable endcap of the apparatus such that removal of the endcap enables removal of the treatment element.

37. Gas treatment apparatus as claimed in claim 33, in which the secured member is secured in place by engagement of at least one projection from said secured member with a slot in the wall of the compartment.

38. Gas treatment apparatus as claimed in claim 37, in which a plurality of projections engage with a plurality of slots in the wall of the compartment.

39. Gas treatment apparatus as claimed in claim 37, in which the secured member is a split ring having a radially inwardly directed portion.

40. Gas treatment apparatus as claimed in claim 33, in which the removable retaining apparatus includes at least one ring gasket between the treatment element and the secured member.

41. Gas treatment apparatus as claimed in claim 33, in which resiliently axially deformable spacers are located between the secured member and the treatment element.

42. Gas treatment apparatus as claimed in claim 33, in which the wall enclosing the treatment element includes an annular joint between two sections of the compartment, the adjacent ends of each section having radially outwardly extending flanges between which a gasket is located, the flanges being held together by a circumferential substantially V-shaped strap, characterised in that the joint includes at least one sealing ring that prevents gas flowing past the treatment element.

43. Gas treatment apparatus as claimed in claim 42, in which the sealing ring is a ceramic string.

44. A vehicle comprising gas treatment apparatus for the treatment of an exhaust gas stream from an internal combustion engine, the gas treatment apparatus being as claimed in claim 33.

* * * * *